US005462113A

United States Patent [19]

Wand

[11] Patent Number: 5,462,113

[45] Date of Patent: Oct. 31, 1995

[54] THREE-CIRCUIT STACKED PLATE HEAT EXCHANGER

[75] Inventor: Steven M. Wand, York City, Pa.

[73] Assignee: FlatPlate, Inc., York, Pa.

[21] Appl. No.: 262,682

[22] Filed: Jun. 20, 1994

[51] Int. Cl.[6] ..... F28F 3/08

[52] U.S. Cl. ..... 165/167; 165/140

[58] Field of Search ..... 165/140, 166, 165/167

[56] References Cited

U.S. PATENT DOCUMENTS

| | | | |
|---|---|---|---|
| 448,521 | 3/1891 | Horner | 165/112 |
| 2,248,933 | 7/1941 | Astle | 165/167 |
| 2,591,878 | 4/1952 | Rogers et al. | 165/167 |
| 2,617,634 | 11/1952 | Jendrassik | 165/140 |
| 3,114,686 | 12/1963 | Edwards et al. | 204/99 |
| 3,240,268 | 3/1966 | Armes | 165/167 |
| 3,255,817 | 6/1966 | Davids et al. | 165/167 X |
| 3,532,161 | 10/1970 | Lockel | 165/167 |
| 4,002,201 | 1/1977 | Donaldson | 165/140 |
| 4,407,359 | 10/1983 | Berger et al. | 165/167 |
| 4,470,455 | 9/1984 | Sacca | 165/167 |
| 4,781,248 | 11/1988 | Pfeiffer | 165/167 |
| 4,987,955 | 1/1991 | Bergqvist et al. | 165/167 |
| 5,137,082 | 8/1992 | Shimoya et al. | 165/110 |
| 5,180,004 | 1/1993 | Nguyen | 165/140 |

FOREIGN PATENT DOCUMENTS

| | | | |
|---|---|---|---|
| 993 | 1/1981 | Japan | 165/167 |
| 254290 | 10/1990 | Japan | 165/167 |
| 73594 | 3/1992 | Japan | 165/167 |
| 660469 | 11/1951 | United Kingdom | 165/140 |

*Primary Examiner*—Leonard R. Leo
*Attorney, Agent, or Firm*—Charles J. Long

[57] ABSTRACT

A stacked plate heat exchanger has flow passages for three different fluids formed between the plates. Passages for the third fluid are adjacent to both sides of each passage for the first fluid and each passage for the second fluid. In a preferred embodiment the passages are formed using only two plate surface configurations, and proper sealing of adjacent plates at the ports forming the inlet and outlet conduits for the three fluids is achieved by configuring the areas around the ports to define a system of annular planar platforms. For improved heat transfer when the exchanger is mounted in the horizontal position, baffles may be formed in the passages for the first and second fluids to control and direct the flow of those fluids.

6 Claims, 9 Drawing Sheets

THREE-CIRCUIT STACKED PLATE HEAT EXCHANGER

BACKGROUND OF THE INVENTION

1. Field of the Invention

This invention relates to stacked plate heat exchangers. More particularly, the invention relates to a stacked plate heat exchanger which accommodates three separate fluid circuits, so that, for example, two refrigerant circuits can transfer heat from a single water circuit in a more desirable and usable manner, wherein each individual refrigerant circuit comes in thermal contact with at least all but one of the water passages.

2. Description of the Prior Art

As is known to those skilled in the art, a stacked plate heat exchanger includes a plurality of plates stacked one atop another and with their surfaces shaped and spaced to form fluid flow passages between adjacent plates. The peripheries of the plates are sealed to prevent fluid leakage and inlet and outlet openings are provided and selectively sealed so that a particular fluid passes only through selected flow passages in the stack. Sealing is accomplished by brazing, soldering or similar processes, or occasionally by use of suitable shaped gaskets positioned between plates and compressed by external clamping means holding the stack together. For optimum heat transfer, counter-current flow is generally used—i.e. the fluid in one passage flows through the stack in a direction opposite to the flow of the fluid in adjacent passages.

In refrigeration applications stacked plate heat exchangers are commonly used as condensers, water chillers, air dryers, oil coolers and other devices for refrigerant to water or oil, refrigerant to air, and refrigerant to refrigerant heat transfer. For example, in a typical prior art water chiller a single circuit of refrigerant—i.e. delivered from one source, passes through alternate flow passages and a single circuit of water passes through the remaining flow passages, whereby the water and refrigerant exchange heat energy. Although such units involve two flow circuits, one for refrigerant and one for water, they are often called single circuit chillers; however, for clarity in description herein, heat exchangers will be defined by the total number of fluid circuits accommodated, e.g. if a heat exchanger accommodates one circuit of refrigerant and one circuit of water, it will be termed a two-circuit exchanger. For purposes of explanation herein, water chillers will generally be the standard for discussion, it being understood that the invention can be used for other combinations of liquid or gaseous fluids.

Numerous designs of two-circuit chillers have been developed by the prior art. Examples of several of these are disclosed in the following listed U.S. Pat. Nos.:

Shimoya, et al. U.S. Pat. No. 5,137,082;

Bergqvist, et al. U.S. Pat. No. 4,987,955;

Pfeiffer No. U.S. Pat. No. 4,781,248;

Sacca U.S. Pat. No. 4,470,455;

Armes U.S. Pat. No. 3,240,268; and

Edwards, et al. U.S. Pat. No. 3,114,686.

It is to be emphasized that all these prior art devices are designed to carry only two fluid circuits, generally a single refrigerant circuit and a single water or other fluid circuit.

In many applications single refrigerant circuits are not adequate, and one or more additional circuits are required. In such multiple circuit versions of water chillers, each separate refrigerant circuit includes a separate refrigerant compressor. This arrangement provides better part load performance, lower chiller load capabilities, and improved reliability and backup if one compressor should fail. The requirement of multiple refrigerant circuits has led to the development of some prior art water chillers in which two or more refrigerant circuits act on one water circuit in the same unit; for example, traditional prior art shell and tube type heat exchangers can be fabricated with two or more refrigerant circuits flowing through different sets of tubes. One prior art stacked plate heat exchanger described as a "multiple fluid" unit is disclosed in Donaldson U.S. Pat. No. 4,002,201; however, Donaldson's unit involves two liquids and one gas such as air, and the gas flows through open spaces provided between alternate liquid-carrying pairs of plates. The Donaldson unit is in effect only a two-circuit exchanger in which the alternating flow passages have been physically separated to form a third flow passage for the third fluid, which is a gas; such flow passage for the third fluid is not an integral part of the plate stack, so strictly speaking Donaldson does not show a stacked plate heat exchanger, as that term is generally understood. The Donaldson unit is not suited to applications where all fluid circuits contain liquids, such as is the case with water chillers.

In fact, with prior art stacked plate heat exchanger technology the inclusion of two or more refrigerant circuits in a single water chiller or other heat exchanger with liquid media in all circuits has been a continuing and complex problem. Prior art stacked plate heat exchangers can be configured into a pseudo three-circuit water chiller by putting two two-circuit heat exchangers back to back with a common water circuit passing through both exchangers. In this arrangement one refrigerant circuit flows through the first exchanger, and the second refrigerant circuit flows through the second separate exchanger. This approach is adequate in some applications, but it has limitations in that only one refrigerant is in contact with the water at any point. When both refrigerant circuits are in operation the arrangement works satisfactorily, but in the majority of water chiller operations only one refrigerant circuit is operating much of the time, and in these situations the prior art arrangement causes control and potential freeze up problems. For example, when only one circuit is attempting to hold a given output temperature for the water flowing through the unit, the operating refrigerant circuit runs at a significantly lower temperature and thereby risks freezing the water which is in contact with that refrigerant in addition to causing higher compressor power requirements. Similar problems arise in alternate prior art arrangements in which one water circuit is split so that 50% of the water flows through one heat exchanger and the other 50% flows through the second heat exchanger, both parts of the water flow coming together down stream of the two exchangers; the thermal relationships are virtually identical in either prior art multiple circuit arrangement.

The problems existing with prior art attempts at three-circuit water chillers could be avoided if both refrigerant circuits were in thermal heat transfer contact with substantially all of the water flowing through the chiller.

SUMMARY OF THE INVENTION

I have developed a three-circuit stacked plate heat exchanger having "interlaced" fluid circuits, in which two of the fluid circuits are in thermal heat transfer contact with essentially all of the third fluid circuit. In preferred embodiments, individual plates of the heat exchanger according to the invention are embossed in such a way that the three circuits can be accommodated using plates of only two different configurations, thus making such preferred embodiments easier and less expensive to manufacture. In other embodiments optional projections formed in the plates create internal baffles which confine and direct the first and second fluid flow within their respective flow passages and thereby allow the heat exchanger to operate in a horizontal mode rather than a vertical mode.

In accordance with the invention I provide a three-circuit stacked plate heat exchanger comprising a stack of at least six generally rectangular plates of uniform outside dimensions arranged in a stacked relationship with the peripheries of adjacent plates connected in a fluid-tight manner, the surface of each plate being configured to create passages for fluid flow between the plate and adjacent plates in the stack, each plate having six ports cut through it, the ports being sized and positioned such that in the stacked plates the ports align to form inlet and outlet conduits through the stack for each of first, second and third fluids to be passed through one or more of the passages, each pair of adjacent plates being connected in a fluid-tight manner around four of the six ports in repeating groups of four successive plates as follows: a) first and second plates connected at the ports forming the inlet and outlet conduits for the first and second fluids; b) second and third plates connected at the ports forming the inlet and outlet conduits for the first and third fluids; c) third and fourth plates connected at the ports forming the inlet and outlet conduits for the first and second fluids; d) fourth plate and first plate of succeeding group of four connected at the ports forming the inlet and outlet conduits for the second and third fluids, the plates being configured around the ports so that where adjacent plates are not connected in the fluid-tight manner a fluid can flow from its inlet conduit into the passage between the adjacent plates and from the passage into the outlet conduit for the fluid, whereby when the first, second and third fluids are introduced into the stack by way of the respective inlet conduits for each, the third fluid will flow through passages on both sides of each first fluid passage and each second fluid passage in the stack.

In an embodiment for horizontal mounting, each plate has a longitudinal axis and a lateral axis, first and second laterally opposite corners at one end and third and fourth laterally opposite corners at the opposite end, the third and fourth corners being diagonally opposite the first and second corners respectively, and a) the first and second fluid inlet conduit ports in each plate are adjacent to one another and located near the first corner of the plate; b) the first and second fluid outlet conduit ports in each plate are adjacent to one another and located near the second corner of the plate; c) the third fluid inlet conduit port in each plate is located at the one end of the plate between the first and second fluid inlet conduit ports and the first and second fluid outlet conduit ports; d) the third fluid outlet conduit port in each plate is located at the opposite end of the plate; e) the surface of each first and third plate is configured to define a peak extending longitudinally from a point at the edge of the one end between the first and second fluid inlet conduit ports and the third fluid inlet conduit port to a point spaced from the opposite end; f) the surface of each second and fourth plate is configured to define a valley corresponding in length and position to the peak in each of the first and third plates; and g) the heights of the peaks in the first and third plates and the depths of the valleys in the second and fourth plates are such that the valley in each second and fourth plate in the stack contacts the peak in each adjacent third and first plate, respectively, to form a baffle for controlling and directing fluid flow.

In an especially preferred embodiment requiring only two plate configurations, I provide a three-circuit stacked plate heat exchanger comprising a stack of generally rectangular plates of uniform outside dimensions arranged in a stacked relationship with the peripheries of adjacent plates connected in a fluid-tight manner, characterized in that: a) the stack consists of first plates of a first configuration alternating with second plates of a second configuration; b) each first and second plate below the top two plates in the stack is rotated by 180° relative to the first or second plate, respectively, above it in the stack; c) each plate has lateral and longitudinal axes; d) each plate includes a heat exchange portion in which the plate surface has peaks and valleys lying in spaced parallel upper and lower planes, respectively; e) each plate has first, second and third pairs of generally circular ports cut through it for allowing fluid passage, one port of each pair being near one end of the plate and the other port of each pair being near the opposite end of the plate, the first and second pairs of ports being situated such that their centers define the corners of a rectangle which is symmetrical with respect to the longitudinal and lateral axes of the plate, the third pair of ports having centers lying on the longitudinal axis of the plate and equidistant from the lateral axis of the plate; f) the surface of each first plate is configured such that: i) each port of the first pair of ports has a first diameter and the plate surface around the edge of each defines an annular planar platform of a first width and distance from the port center lying in the lower of the parallel planes; ii) each port of the second pair of ports has a second diameter and the plate surface around each defines first and second annular planar platforms, the first platform being of the first width and distance from the port center and lying in the lower of the parallel planes, the second platform being of a second width and distance from the port center and lying in the upper of the parallel planes, the inner edge of one of the first and second platforms being the edge of the port, the inner edge of the other of the first and second platforms being radially outward from the outer edge of the one platform, the plate surface further defining a section connecting the radially outer edge of the one platform with the radially inner edge of the other platform; and iii) each port of the third pair of ports has a third diameter and the plate surface around the edge of each defines an annular planar platform of a third width lying in the upper of the parallel planes; g) the surface of each second plate is configured such that: i) each port of the first pair of ports has the abovementioned second diameter and the plate surface around each defines first and second annular planar platforms, the first platform being of the above-mentioned first width and distance from the port center and lying in the upper of the parallel planes, the second platform being of the above-mentioned second width and distance from the port center and lying in the lower of the parallel planes, the inner edge of one of the first and second platforms being the edge of the port, the inner edge of the other of the first and second platforms being radially outward from the outer edge of the one platform, the plate surface further defining a section connecting the radially outer edge of the one platform to the radially inner edge of the other platform; ii) each port of the second pair of ports has the above-mentioned first diameter and the plate surface around the edge of each defines an annular planar platform of the above-mentioned first width and distance from the port center lying in the upper of the parallel planes; and iii) each port of the third pair of ports has the above-mentioned third diameter and the plate surface around the edge of each defines an annular planar platform of the above-mentioned third width lying in the lower of the parallel planes; and h) abutting surfaces of planar platforms in adjacent plates are joined in a fluid-tight manner.

In a two plate embodiment particularly suitable for mounting in a horizontal position I provide a three-circuit stacked plate heat exchanger comprising a stack of generally rectangular plates of uniform outside dimensions arranged in a stacked relationship with the peripheries of adjacent plates connected in a fluid-tight manner, characterized in that: a) the stack consists of first plates of a first configuration alternating with second plates of a second configuration; b) each first and second plate below the top two plates in the stack is rotated by 180° relative to the first or second plate, respectively, above it in the stack; c) each plate has lateral and longitudinal axes; d) each plate includes a heat exchange portion in which the plate surface has peaks and valleys lying in spaced parallel upper and lower planes, respectively; e) each plate has six generally circular ports cut through it for allowing fluid passage, the ports consisting of first and second ports adjacent to each other near one corner of the plate, third and fourth ports adjacent to each other near the diagonally opposite corner of the plate, and fifth and sixth ports at respectively opposite ends of the plate, the centers of both the first and fourth ports being first and second distances from the longitudinal and lateral axes respectively, the centers of both the second and third ports being the first distance from the longitudinal axis and a third distance from the lateral axis, and the centers of the fifth and sixth ports lying on the longitudinal axis and being equidistant from the lateral axis; f) the surface of each first plate is configured such that: i) each of the first and third ports has a first diameter and the plate surface around the edge of each defines an annular planar platform of a first width and distance from the port center lying in the lower of the parallel planes; ii) each of the second and fourth ports has a second diameter and the plate surface around each defines first and second annular planar platforms, the first platform being of the first width and distance from the port center and lying in the lower of the parallel planes, the second platform being of a second width and distance from the port center and lying in the upper of the parallel planes, the inner edge of one of the first and second platforms being the edge of the port, the inner edge of the other of the first and second platforms being radially outward from the outer edge of the one platform, the plate surface further defining a section connecting the radially outer edge of the one platform with the radially inner edge of the other platform; iii) each of the fifth and sixth ports has a third diameter and the plate surface around the edge of each defines an annular planar platform of a third width lying in the upper of the parallel planes; and iv) the plate surface includes first and second longitudinally extending peaks the tops of which lie in the upper of the parallel planes, the first peak lying between the fifth port and the first and second ports and extending from a first end of the plate nearest the first and second ports to a point spaced from the opposite end by a distance of up to about one-third of the plate width, the second peak lying between the sixth port and the third and fourth ports and extending from the opposite end to a point spaced from the first end by a distance of up to about one-third of the plate width, the peaks being equidistant from and parallel to the longitudinal axis of the plate; g) the surface of each second plate is configured such that: i) each of the first and third ports has the above-mentioned second diameter and the plate surface around each defines first and second annular planar platforms, the first platform being of the above-mentioned first width and distance from the port center and lying in the upper of the parallel planes, the second platform being of the above-mentioned second width and distance from the port center and lying in the lower of the parallel planes, the inner edge of one of the first and second platforms being the edge of the port, the inner edge of the other of the first and second platforms being radially outward from the outer edge of the one platform, the plate surface further defining a section connecting the radially outer edge of the one platform to the radially inner edge of the other platform; ii) each of the second and fourth ports has the above-mentioned first diameter and the plate surface around the edge of each defines an annular planar platform of the above-mentioned first width and distance from the port center lying in the upper of the parallel planes; iii) each of the fifth and sixth ports has the abovementioned third diameter and the plate surface around the edge of each defines an annular planar platform of the above-mentioned third width lying in the lower of the parallel planes; and iv) the surface includes first and second longitudinally extending valleys the bottoms of which lie in the lower of the parallel planes, the positions and lengths of the first and second valleys corresponding to the positions and lengths of the above-mentioned first and second peaks, respectively; and h) abutting surfaces in adjacent plates are joined in a fluid-tight manner.

Other details, objects and advantages of the invention will become apparent as the following description of certain present preferred embodiments thereof proceeds.

BRIEF DESCRIPTION OF THE DRAWINGS

In the accompanying drawings I have shown certain present preferred embodiments of the invention in which:

FIG. 1 is broken away;

FIG. 14 is a sectional view taken on the line 14—14 of

FIG. 12 through the ports for the second and third fluids; and

DESCRIPTION OF THE PREFERRED EMBODIMENTS

Figure 1:
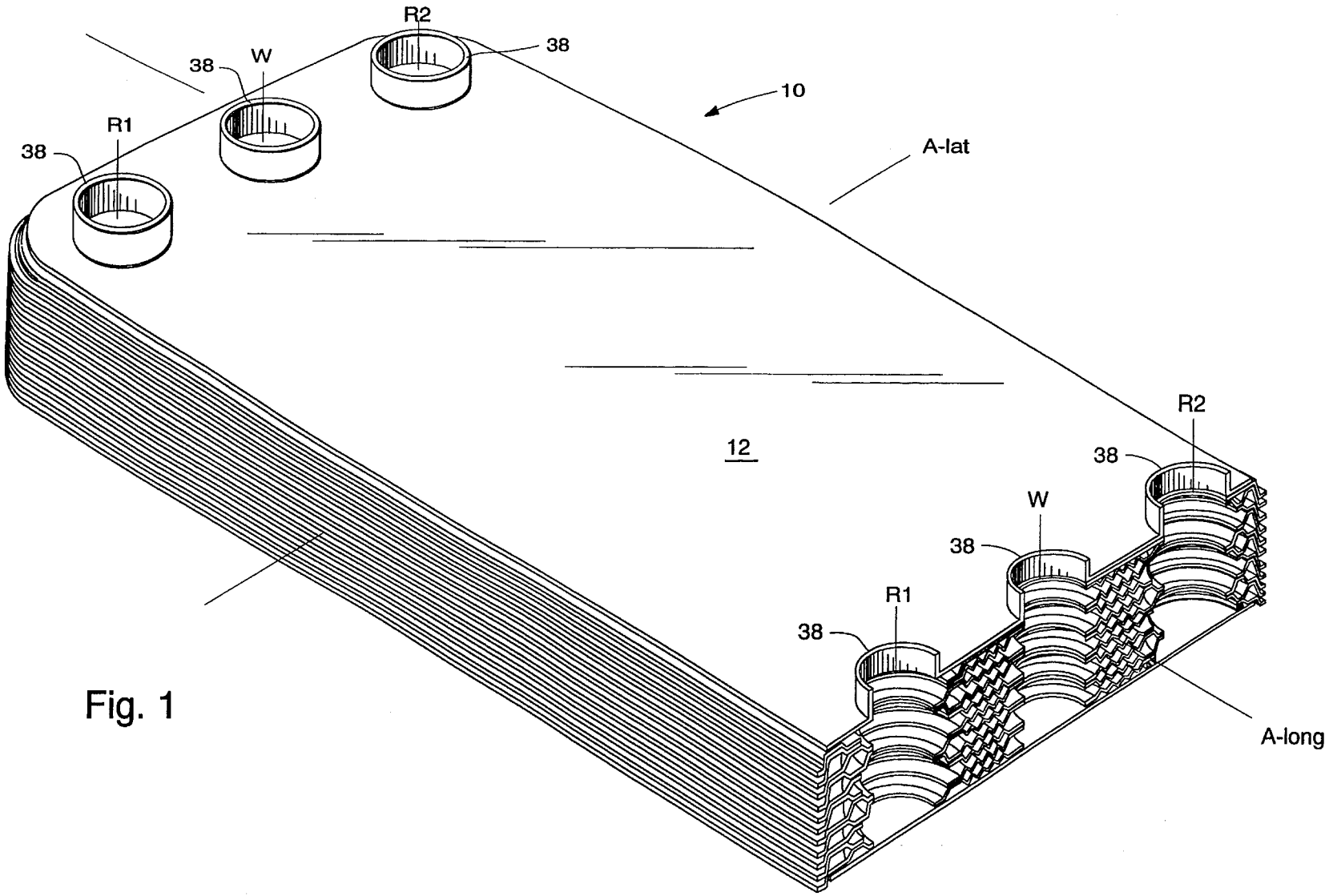
FIG. 1 is a perspective view of a stacked plate heat exchanger according to the preferred embodiment of the invention in which only two plate configurations are used in the interior stack, with the near end of the exchanger being broken away to show the interior structure.
Figure 11:
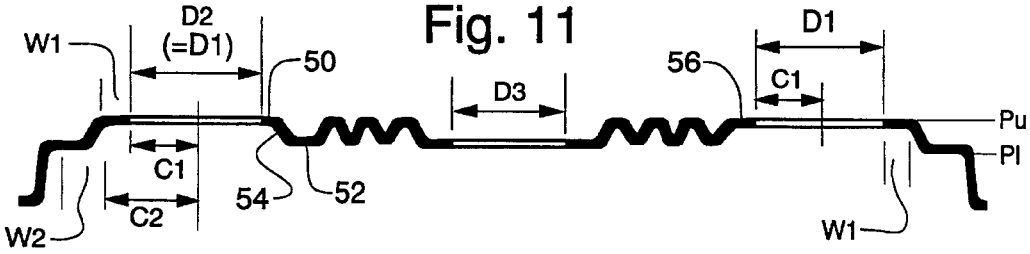
FIG. 11 is a view like FIG. 9 but showing an alternate configuration for the plate of FIG. 8.
Figure 12:
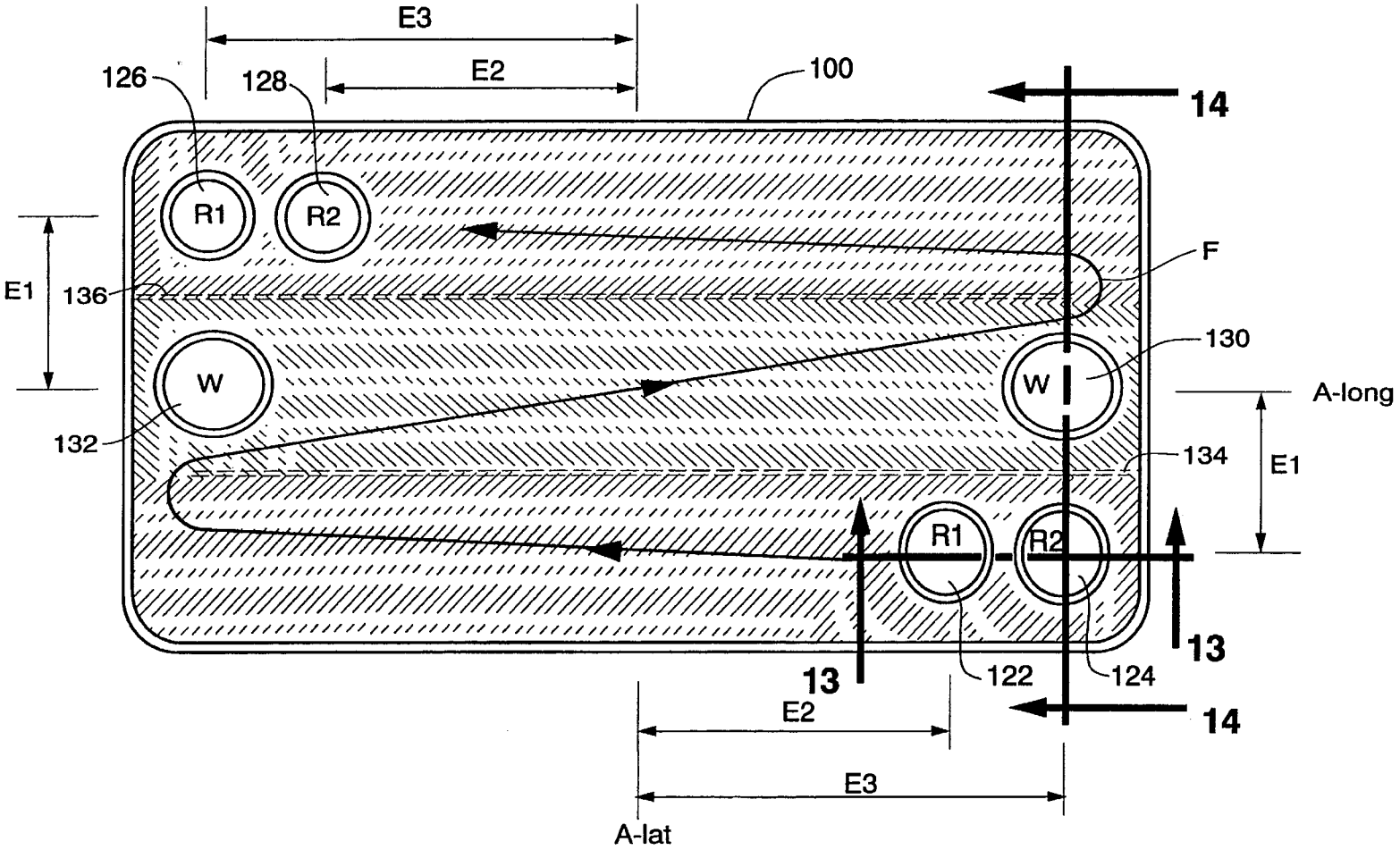
FIG. 12 is a top view of a heat exchanger according to a second embodiment of the invention, again involving only two plate configurations in the stack, but having two internal baffles in selected fluid flow passages to control and direct fluid flow.
Figure 15:
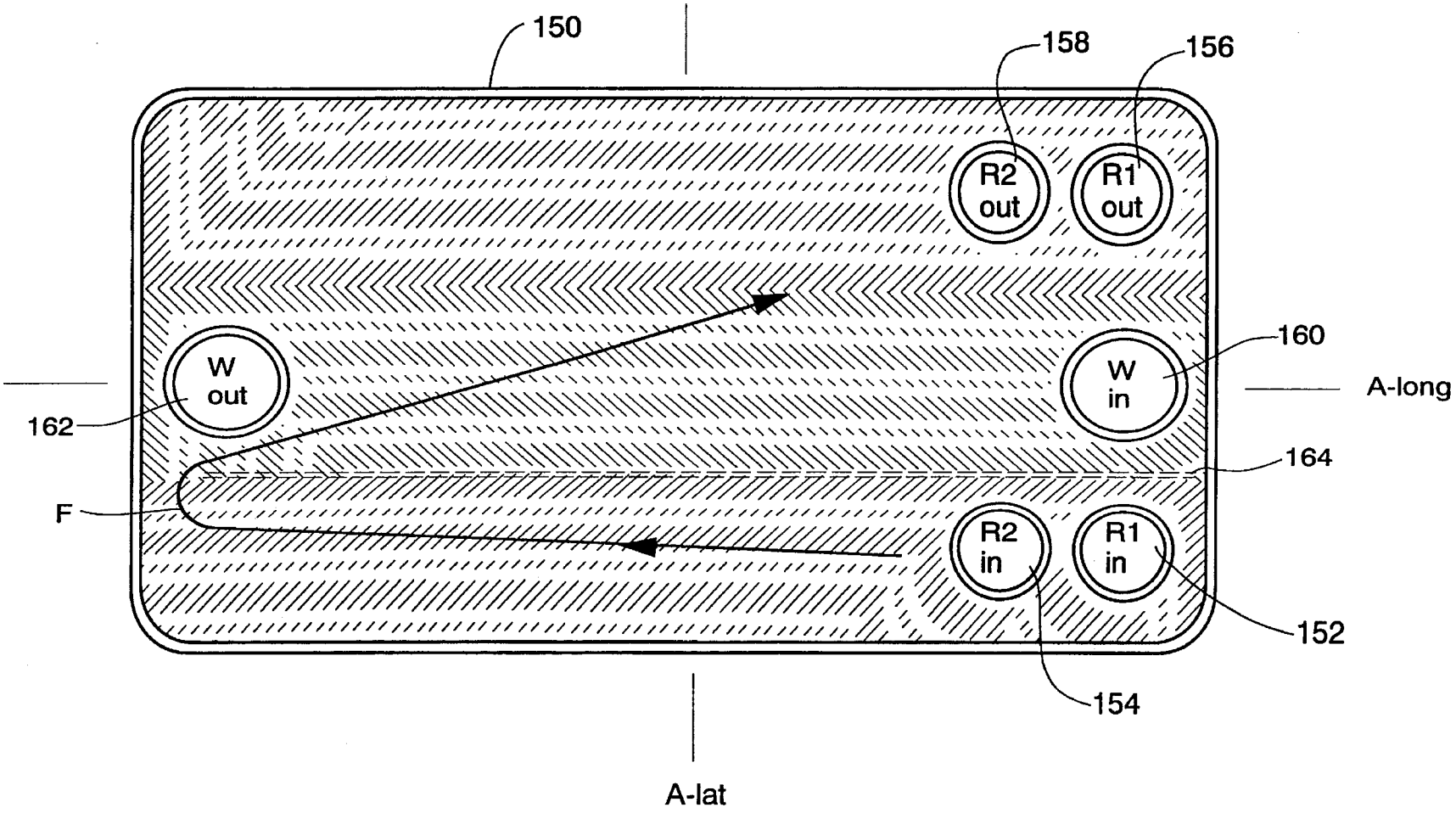
FIG. 15 is a top view of a heat exchanger according to a third embodiment of the invention requiring more than two plate configurations and having one internal baffle in selected fluid flow passages to control and direct fluid flow.

Referring to the drawing figures generally, all depict one or another version of a three-circuit stacked plate heat exchanger, identified as 10 in FIG. 1, 100 in FIG. 12 and 150 in FIG. 15, which is formed from a series of generally rectangular plates stacked one atop another and connected around their peripheries in a fluid-tight manner; overall length of a typical heat exchanger may be twice its overall width, with its height depending on the number of plates in the stack. Referring to FIGS. 1–11, the heat exchanger includes a cover plate 12, a back plate 14, a top sealing plate 16 and a stack of ten interior plates in accordance with the invention, identified as 18, 20, 18R and 20R. Cover plate 12 and back plate 14 are flat and somewhat thicker than the other plates so as to provide structural rigidity. Each of the other plates in the stack has a downwardly and outwardly flared peripheral skirt portion 21 so that in the stack adjacent plates will "nest" with one another for optimum sealing. The number of interior plates in the stack is determined largely by the cooling and flow capacity required in the heat exchanger; as discussed hereinbelow, at least six such plates are required for the invention to function as intended, but typically such heat exchangers may employ from twenty to as many as one hundred twenty interior plates in the stack. The ten-plate interior stack shown in the drawings was chosen for convenience in illustrating the invention. Each plate has longitudinal and lateral axes A-long and A-lat, respectively.

The plate material utilized in my heat exchanger is typically selected from annealed Type 304 or 316 stainless steel and 90/10 copper/nickel alloy, although other materials such as dead soft annealed titanium could also be used; selection of specific plate material is deemed to be within the ordinary skill of the art. Also, the term "connected in a fluid-tight manner" as used herein refers to connection by any of several means used in the stacked plate heat exchanger art, such as brazing, soldering, use of gaskets, etc. as mentioned hereinabove. I prefer to use a vacuum brazing process in which a layer of thin copper foil is positioned between abutting surfaces of plates in the stack and the stack is then vacuum brazed whereby the copper fuses to the abutting plate surfaces to produce fluid-tight connections. In this specification and the claims following the term "abutting surfaces" means surfaces which actually abut or would abut in the absence of any interposed layer; strictly speaking, after sealing such surfaces contact the sealing means and not each other, but for convenience I use the term "abutting" for such surfaces both before and after sealing.

FIGS. 1 through 11 show a three-circuit stacked plate heat exchanger in which the interior stack consists of plates having only two different configurations which alternate with each other in the stack and in which alternating plates of like configuration are reversed to provide the three fluid circuits. Accordingly, first plates 18 of a first configuration alternate with second plates 20 of a second configuration; the letter "R" is applied next to a plate number in the drawing figures to indicate that the plate has been rotated by 180° —i.e. end for end—from the initial orientation at the top of the stack, such initial orientation being shown in FIGS. 6 and 8 for plates 18 and 20, respectively. It will thus be appreciated that each first and second plate 18 and 20 below the top two plates in the stack is rotated by 180° relative to the first or second plate, respectively, above it in the stack.

Figure 6:
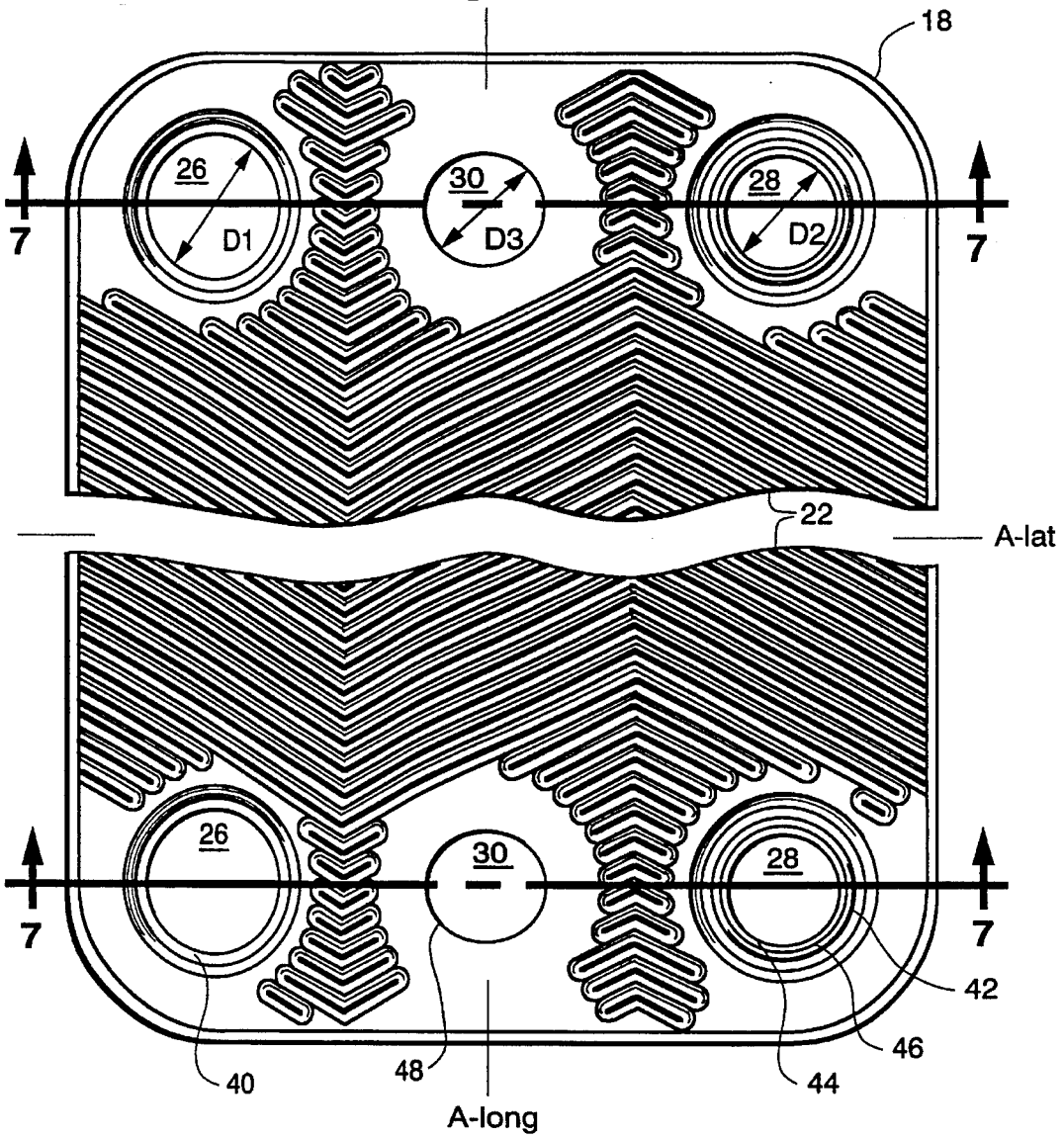
FIG. 6 is a plan view of one of the two plate configurations used in the heat exchanger of FIG. 2, with the center portion omitted to shorten the figure.

Each first plate 18 includes a heat exchange portion 22 and each second plate 20 includes a heat exchange portion 24. In the heat exchange portion the plate surface has peaks and valleys lying in spaced parallel upper and lower planes $P_u$ and $P_l$, respectively; the locations of planes $P_u$ and $P_l$ are shown for plates 18 in FIGS. 7 and 10 and for plates 20 in FIGS. 9 and 11. Planes $P_u$ and $P_l$ may for example be spaced apart by 3/32" in a typical exchanger according to the invention, it will be appreciated that to be able to form the heat exchange portion between planes which are only 3/32" apart, the plates must be of thin, suitably ductile sheet metal, as is known in the art; a common plate material, and one which I may use in the practice of the invention, is 0.016" thick, and I generally shape the plate by a known method such as die stamping or embossing. In the embodiment shown the heat exchange portions are configured as regularly spaced corrugations over the plate surface except for areas at each end around fluid flow ports described more fully hereinbelow. As shown in FIGS. 6 and 8, the peaks and valleys of the corrugations extend across plates 18 and 20 in a three part chevron pattern with direction change points on longitudinal lines dividing the plate width into thirds. Viewing FIG. 6 as showing plate 18 with its longitudinal axis vertical, the corrugations of plate 18 extend downwardly from the left side at about a 30° angle from the horizontal for ⅓ of the plate width, then upwardly at the same angle for the central ⅓ of the plate width, and finally downwardly again for the remaining ⅓ of the plate width; the corrugations of plate 20 shown in FIG. 8 follow a pattern which is the mirror image of the plate 18 pattern. Thus, when plates 18 and 20 alternate in the stack, the valleys of each plate contact the peaks of the plate below it at the points where the corrugations in the former cross those in the latter, thereby creating passages between adjacent plates which allow fluid flow but force such flow into non-linear paths because of the obstacles formed at the corrugation contact points; as is known to those skilled in the art, such non-linear flow is preferred for optimum heat transfer. Although corrugations have been used in stacked plate heat exchangers of the prior art, they have usually been in single chevron patterns—i.e. forming V's across the plate; I have found, however, that for the preferred reversing two-plate embodiment of the invention, a corrugation pattern which divides the plate width into an odd number of equal sections is necessary; although I prefer the triple chevron pattern shown, another suitable pattern is one in which parallel corrugations extend across the plate in unbroken straight lines at an angle with the lateral axis. Other surface configurations may of course be possible, provided that they are such as to create passages for fluid flow between adjacent plates in the stack.

As shown in FIGS. 6 and 8, each plate 18 and 20 has first, second and third pairs of generally circular ports, 26, 28, 30 for plate 18 and 32, 34, 36 for plate 20, cut through it for fluid passage, a total of six such ports in each plate. The ports are arranged symmetrically about both the longitudinal axis A-long and lateral axis A-lat, with one port of each pair being near one end of the plate and the other port of each pair being near the opposite end of the plate. Port pairs 26, 28 in plate 18 and 32, 34 in plate 20 are positioned such that their centers define the corners of a rectangle which is symmetrical with respect to the longitudinal and lateral axes of the plate, and port pairs 30 and 36 are positioned with their port centers on the plate's longitudinal axis and equidistant from its lateral axis. The distance of ports 30 and 36 from the lateral axis of plates 18 and 20, respectively, need not be the same as that of ports 26, 28 and 32, 34 from the same axis, but such distances may conveniently all be equal and are shown as such in the drawing figures. As is evident from FIGS. 1 through 5, ports corresponding in size and location to those in plates 18 and 20 are also cut through cover plate 12 and top sealing plate 14, and cover plate 12 additionally includes fittings 38 attached at each port for connection to hoses or the like for delivery and withdrawal of fluids. In the assembled heat exchanger the ports align in the stack to form inlet and outlet conduits for each of first, second and third fluids, R1, R2 and W, respectively flowing through the exchanger.

Three-circuit heat exchangers according to the invention are used for heat transfer between each of first and second fluids, most commonly refrigerants, and a third fluid, typically water. As mentioned hereinabove, I have found that in order to optimize such transfer in a unitary structure the third fluid flow passages must be "interlaced" with first and second fluid flow passages. In the arrangement that I have found to be most practical, heat exchangers according to the invention are constructed so that each flow passage for the first or second fluid has flow passages for the third fluid on both sides of it—i.e. both the first and second fluids have 100% of their flow passage walls in heat transfer contact with the third fluid. Looked at another way, in the embodiment shown in FIGS. 1 through 5, each flow passage for the third fluid except those at the top and bottom of the stack has a flow passage for the first fluid on one side of it and a flow passage for the second fluid on the other side; thus, in the typical case where the first and second fluids are refrigerants, the third fluid is water, and the interior stack includes twenty or more plates, my exchanger causes virtually full thermal contact of the water with both refrigerants throughout the stack, thereby maximizing heat transfer to or from the water not only when both refrigerants are active but also when only one refrigerant is active, e.g. when only partial cooling capacity is being utilized.

I have found that the above-discussed flow patterns can be achieved utilizing only two interior stack plate configurations by forming the areas around the ports in each plate in the following described manner.

Figure 2:
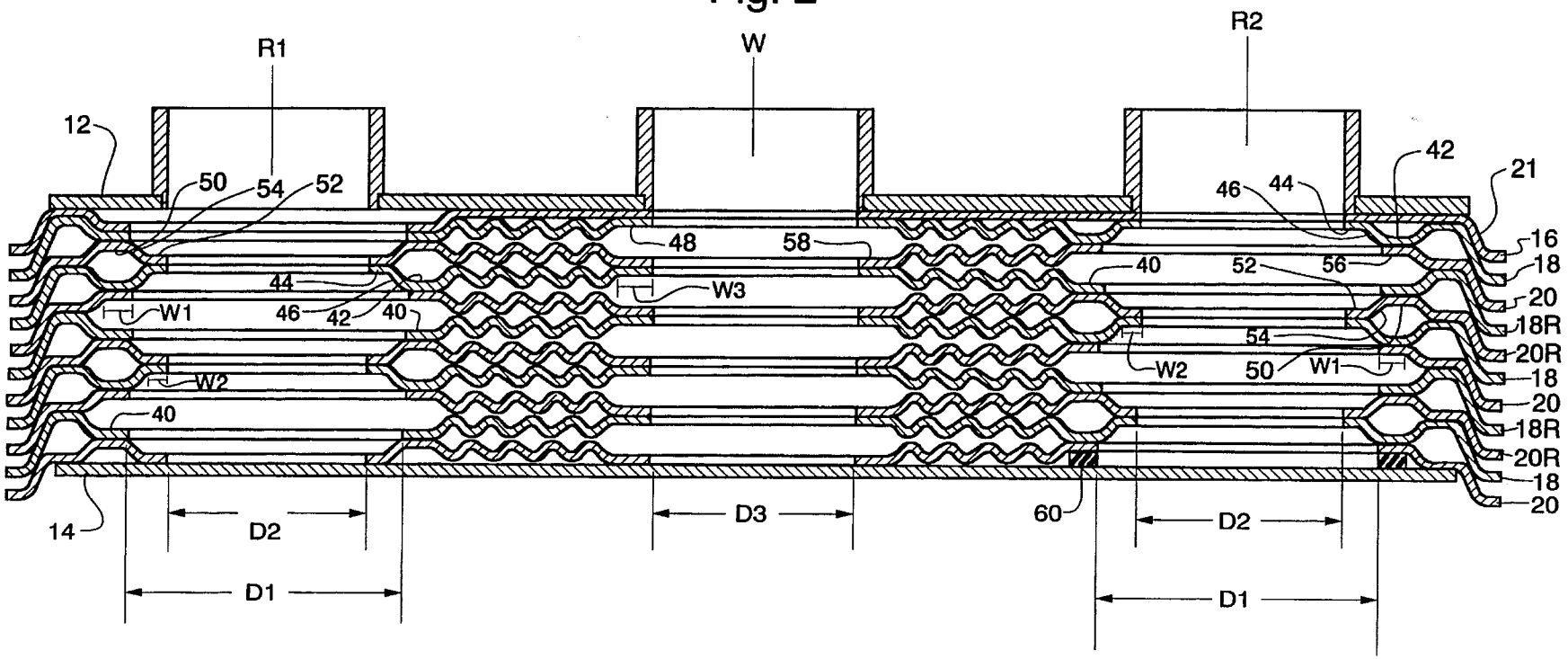
FIG. 2 is a cross sectional view through the structure of FIG. 1 taken at the point where
Figure 7:
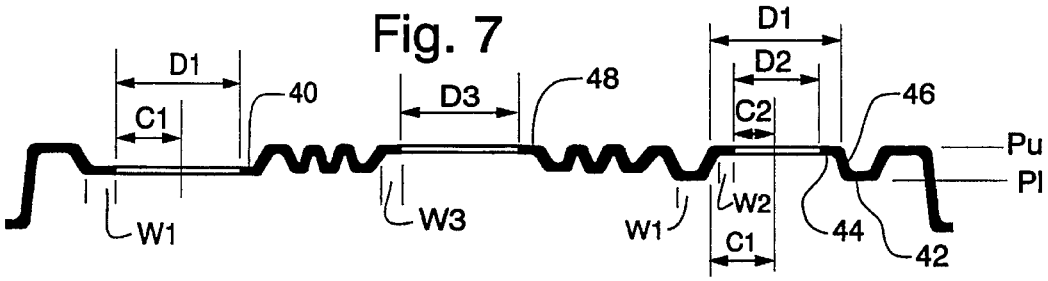
FIG. 7 is a cross sectional view taken along either of the lines 7—7 of FIG. 6, showing in stylized form the plate contour around each of the fluid ports.
Figure 8:
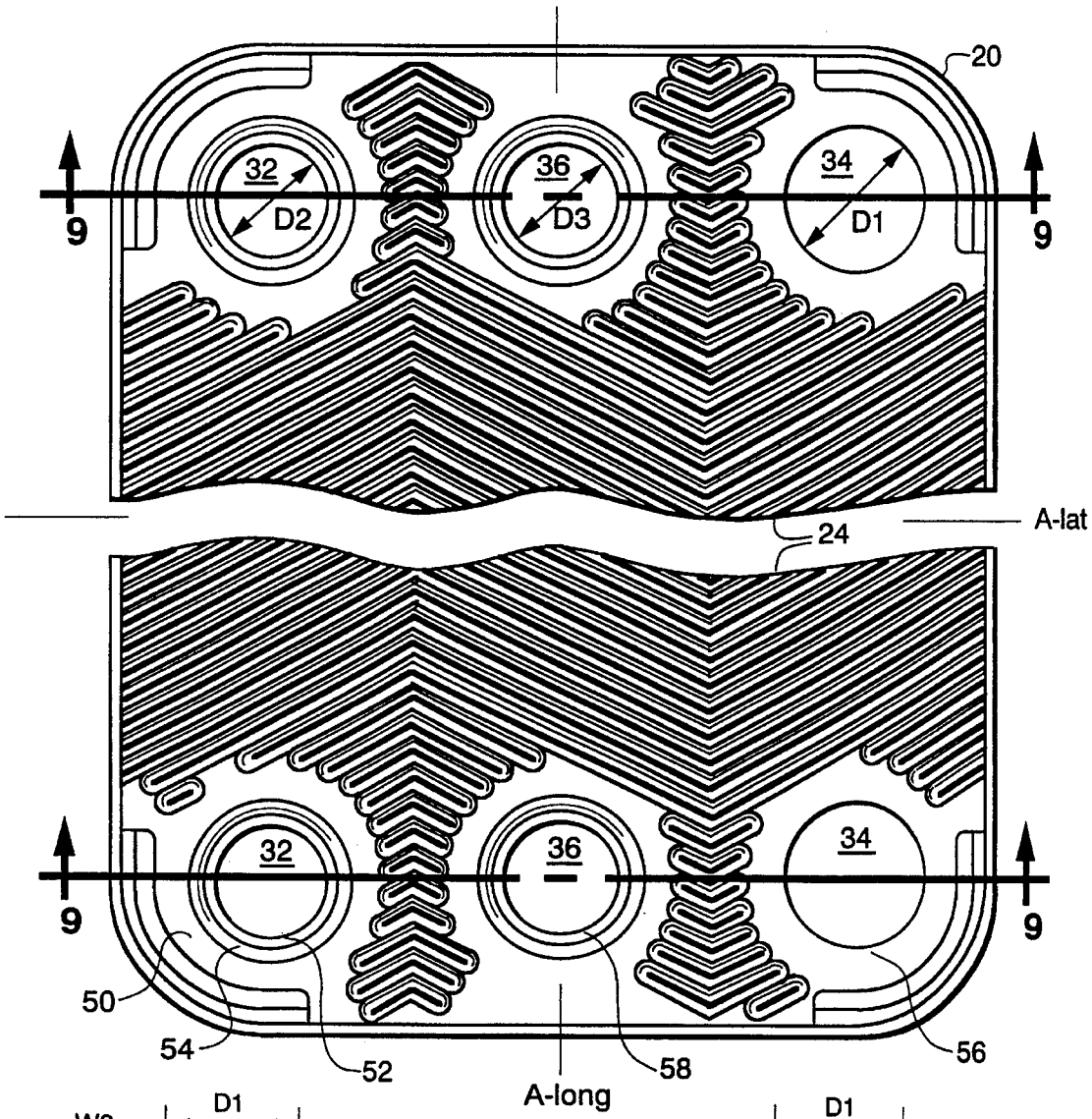
FIG. 8 is a plan view similar to FIG. 6 but showing the second of the two plate configurations used in the heat exchanger of FIG. 2.

Referring to FIGS. 2, 6 and 7 the configuration of plate 18 around its fluid ports 26, 28, 30 is as follows:

Each port 26 has a first diameter D1 and the plate surface around the edge of the port defines an annular planar platform 40 lying in lower plane $P_l$ and having a first width W1 and distance from the port center C1. Each port 28 has a second diameter D2 and the plate surface around the port defines two annular planar platforms 42, 44, one of which 42 has width W1 and distance from the port center C1 and lies in lower plane $P_l$, and the other of which 44 has a second width W2 and distance from the port center C2 and lies in upper plane $P_u$. In FIGS. 1 through 9 the inner edge of platform 44 is the edge of the port 28, the inner edge of platform 42 is radially outward from the outer edge of platform 44, and the plate surface defines a section 46 connecting the adjacent edges of platforms 42 and 44. Each port 30 has a third diameter D3 and the plate surface around the edge of the port defines an annular planar platform 48 of a third width W3 lying in upper plane $P_u$.

Figure 9:
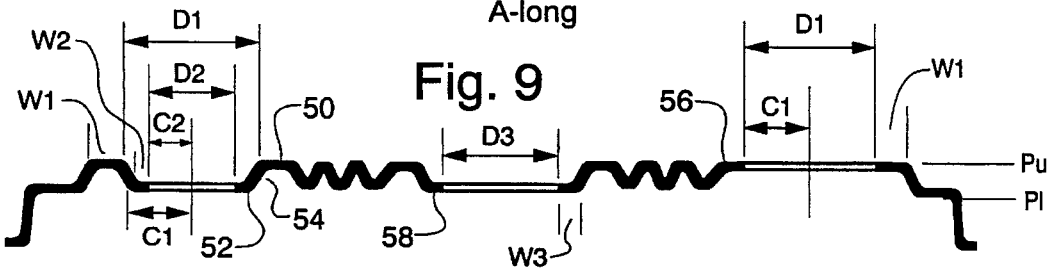
FIG. 9 is a cross sectional view taken along either of the lines 9—9 of FIG. 8 showing in stylized form the plate contour around each of the fluid ports.

Referring to FIGS. 2, 8 and 9, the configuration of plate 20 around its fluid ports 32, 34, 36 is as follows: each port 32 has the same diameter D2 as ports 28 in plate 18 and the plate surface around the port defines two annular platforms 50, 52, one of which 50 lies in upper plane $P_u$ and is of the same width W1 and distance C1 from the port center as platforms 40 in plate 18; the second platform 52 around port 32 lies in the lower plane $P_l$ and has the same width W2 and distance C2 from the port center as platforms 44 in plate 18. In FIGS. 1 through 9 the inner edge of platform 52 is the edge of the port 32, the inner edge of platform 50 is radially outward from the outer edge of platform 52, and a section 54 defined by the plate surface connects the adjacent edges of platforms 50 and 52. Each port 34 has diameter D1 and the plate surface around the edge of the port defines an annular platform 56 of width W1 and distance C1 from the port center and lying in the upper plane $P_u$. Finally, each port 36 has the same diameter D3 as ports 30 in plate 18, and the surface around the edge of the port defines an annular platform 58 lying in the lower plane $P_l$ and having the same width W3 as platform 48 in plate 18.

Plates 18 and 20 configured as above described are fabricated by stamping or other common means known in the art.

In assembling the heat exchanger shown in FIGS. 1 through 5, the interior stack is built up as shown—i.e. beginning at the top of the stack in FIG. 2, with plate 18 oriented as in FIG. 6 at the top, plate 20 oriented as in FIG. 8 beneath it, then plate 18 rotated by 180° (18R), below that plate 20 rotated by 180° (20R), then plate 18 oriented as in FIG. 6, plate 20 oriented as in FIG. 8, and so forth in the same repeating pattern until the desired number of plates is reached. It should be understood that although the repeated stacking pattern involves four plates, the number of plates in the finished stack may not be divisible by 4—i.e. the stack may end only part way through the pattern, as is in fact the case in FIGS. 1 through 5. After such assembly, top sealing plate 16 is positioned on the stack and an annular gasket 60 is positioned below ports 34 of the lowermost plate 20 to provide added structural strength and to seal the space between plate 20 and back plate 14 at those locations. No such gasket is needed around ports 32 or 36 because platforms 52 and 58 are in the lower plane $P_l$ and thus abut plate 14. As shown in FIG. 2, top sealing plate 16 is configured above ports 26 in plate 18 to match the configuration of plate 18 around those ports to provide proper sealing when the assembled unit is brazed. No such special configuration is needed above ports 28 and 30 because platforms 48 and 44 are in the upper plane $P_u$ and thus abut the flat surface of plate 16 in the assembled unit.

When all plates are positioned in the stack, including back plate 14 and cover plate 12 with fittings 38, the assembly is vacuumed brazed to connect all abutting surfaces in a fluid-tight manner. In the embodiment of FIGS. 1 through 5 such connections are formed for example along the peripheral skirts of adjacent plates, between cover plate 12 and top sealing plate 16, between back plate 14 and the portions of the lowermost plate 20 abutting it, and at the points where the peaks and valleys of the heat exchange portions of adjacent interior stack plates cross and abut. Most importantly with regard to the invention, between each pair of adjacent plates in the interior stack such fluid-tight connections are formed around four of the six ports in the plates. Thus, viewing FIGS. 1 through 9, and assuming a water chiller where a first refrigerant R1 is the first fluid, a second refrigerant R2 is the second fluid and water W is the third fluid, fluid-tight connections are as follows: the first and second plates 18 and 20 are connected at the ports forming the conduits for the first and second fluids R1 and R2 by virtue of platforms 40 and 42 in plate 18 abutting platforms 50 and 56, respectively, in plate 20. The second and third plates 20 and 18R are connected at the ports forming the conduits for the first and third fluids R1 and W by virtue of platforms 52 and 58 in plate 20 abutting platforms 44 and 48, respectively, in plate 18R. The third and fourth plates 18R and 20R are connected at the ports forming the conduits for the first and second fluids R1 and R2 by virtue of platforms 42 and 40 and plate 18R abutting platforms 56 and 50, respectively, in plate 20R. The fourth plate 20R and the first plate 18 of the succeeding group of four are connected at the ports forming the conduits for the second and third fluids R2 and W by virtue of platforms 52 and 58 in plate 20R abutting platforms 44 and 48, respectively, in plate 18. The platform connection pattern then repeats through the rest of the interior stack. It will of course be appreciated that at those ports where the plates are not connected in a fluid-tight manner the fluid entering an inlet port flows through the passage formed between plates and is withdrawn via the corresponding outlet port.

Figure 3:
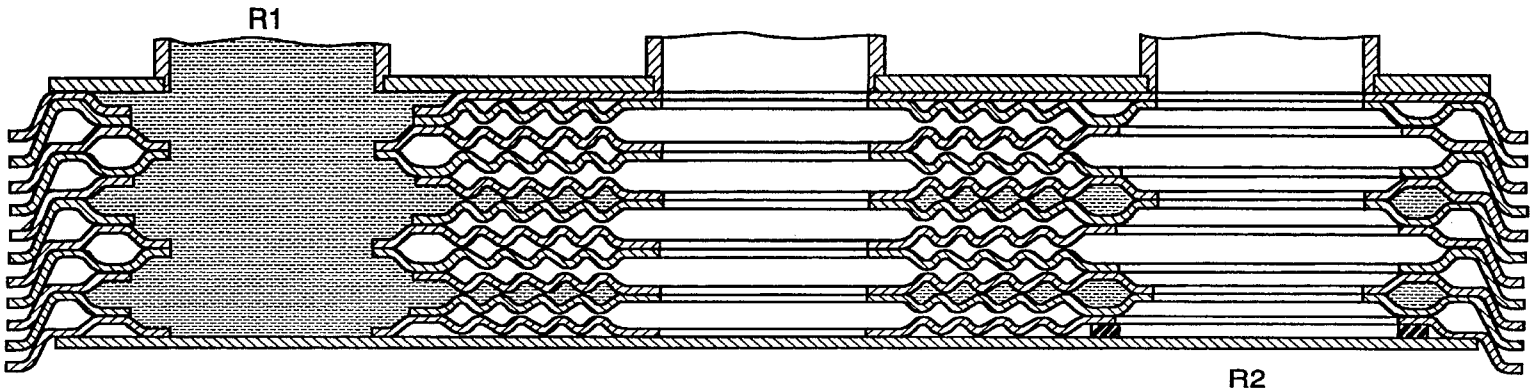
FIGS. 3, 4 and 5 are duplications of FIG. 2 with portions shaded to show fluid flow passages filled with first, second and third fluids, respectively.
Figure 4:
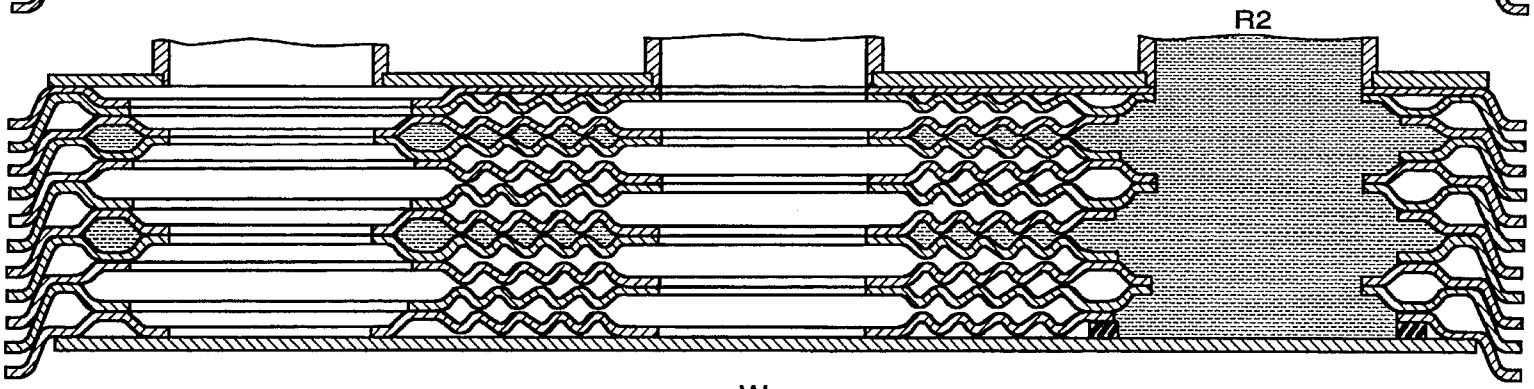
Figure 5:
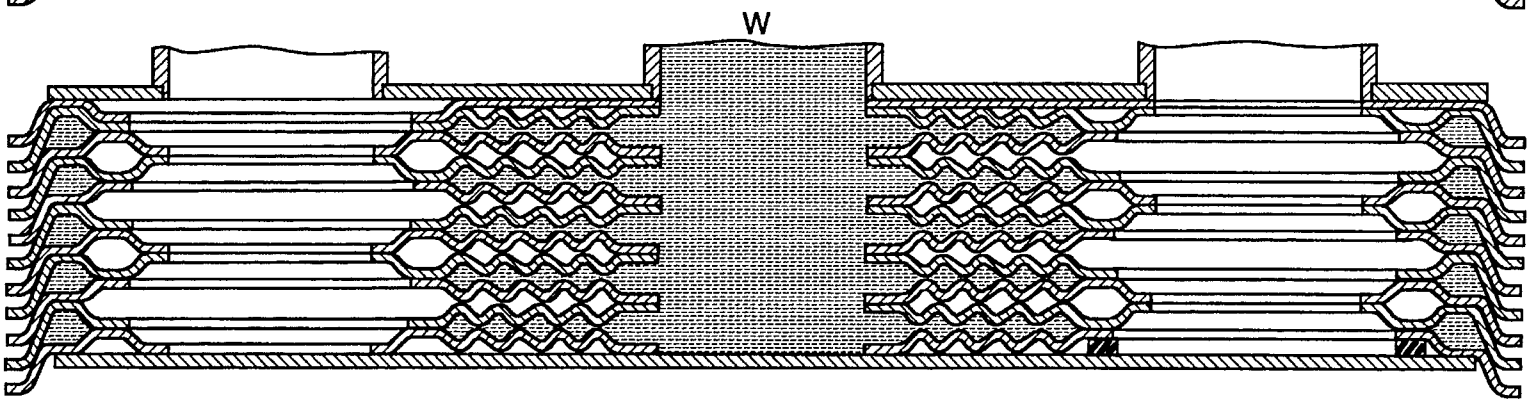

FIGS. 3 through 5 show the fluid flow patterns established by the above-described selective port sealing in the heat exchanger of FIG. 2 and other heat exchangers according to the invention. The portions of the stack interior occupied by each of the first, second and third fluids R1, R2 and W are shaded in FIGS. 3, 4 and 5, respectively. Comparison of those figures shows that the third fluid W, which is water in a typical water chiller according to the invention, flows through passages on both sides of each passage for the first fluid R1 and the second fluid R2, which are refrigerants in a typical water chiller according to the invention.

Figure 10:
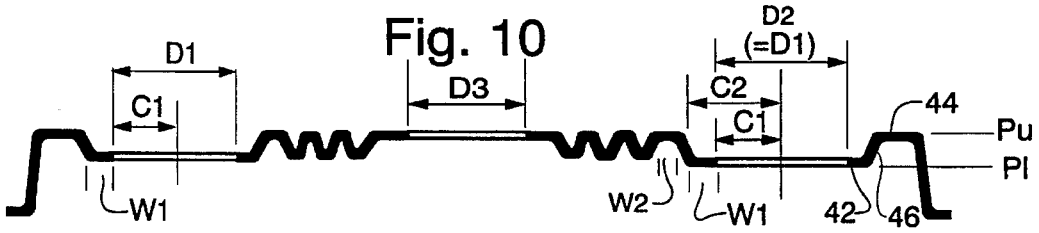
FIG. 10 is a view like FIG. 7 but showing an alternate configuration for the plate of FIG. 6.

FIGS. 10 and 11 show in stylized fashion alternative configurations of the port areas in plates 18 and 20, respectively, of the preferred two-plate version of my invention. The differences occur with respect to ports 28 in plate 18 and ports 32 in plate 20, the other port areas in each plate being unchanged between FIGS. 7 and 10 and FIGS. 9 and 11. As described hereinabove, in FIG. 7 platform 44 is radially inboard of platform 42 and in FIG. 9 platform 52 is radially inboard of platform 50. I have found that in some cases it may be preferable to reverse the radial positions of the platforms at ports 28 and 32, and such reversal is illustrated in FIGS. 10 and 11. Thus, in FIG. 10 platform 42 is radially inboard of platform 44 and in FIG. 11 platform 50 is radially inboard of platform 52. It will also be seen that in this alternate configuration the second diameter D2 is equal to the first diameter D1.

It will be appreciated that although the drawing figures herein show the described annular planar platforms as having particular widths relative to the other plate dimensions, no specific relative platform width is required in the practice of the invention, the only requirement in such regard being that the various platforms abut as described herein so as to form fluid-tight connections completely around the selected ports. For example, I intend to include within the scope of the invention heat exchangers wherein the platforms are only the highest or lowest points of circular peaks or valleys respectively around the ports, such that the area of platform abutment in each case is essentially a circular line.

Referring again to FIG. 1, the preferred heat exchanger of FIGS. 1 through 9 functions best in either the flat position—i.e. with both plate axes A-long and A-lat horizontal, or the vertical position—i.e. with axis A-long vertical and axis A-lat horizontal. In some applications, however, horizontal mounting of the heat exchanger is necessary, wherein axis A-long is horizontal and axis A-lat is vertical; in such orientation the port arrangement of the embodiments of FIGS. 1 through 9 results in less than optimum flow patterns for the fluids passing through the exchanger, particularly those of the first and second fluids when such are refrigerants and the third fluid is water. The following discussion will be in terms of such a three-circuit water chiller in which the first and second fluids are refrigerants and the third fluid is water.

Figure 13:
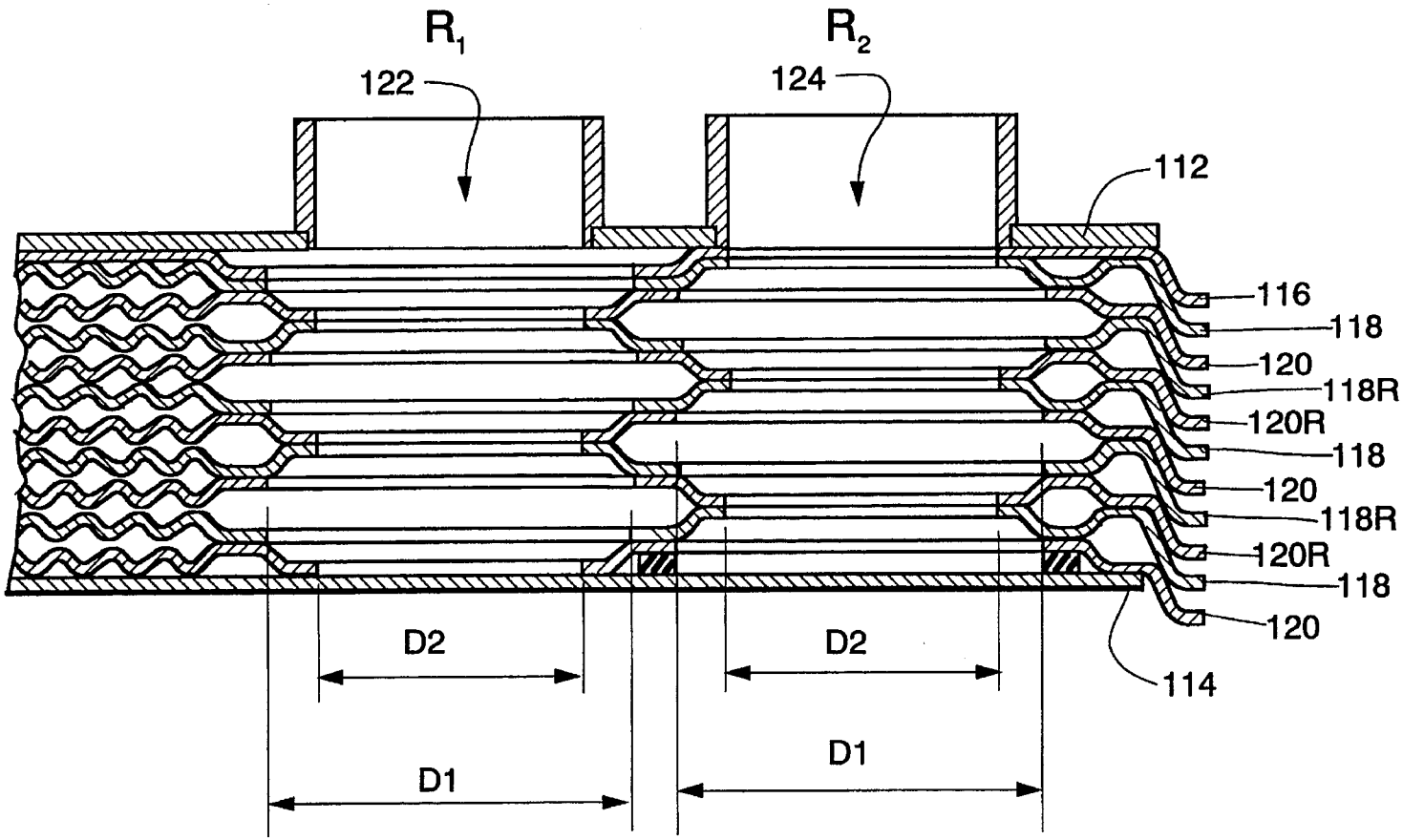
FIG. 13 is a sectional view taken on the line 13—13 of FIG. 12 through the ports for the first and second fluids.
Figure 14:
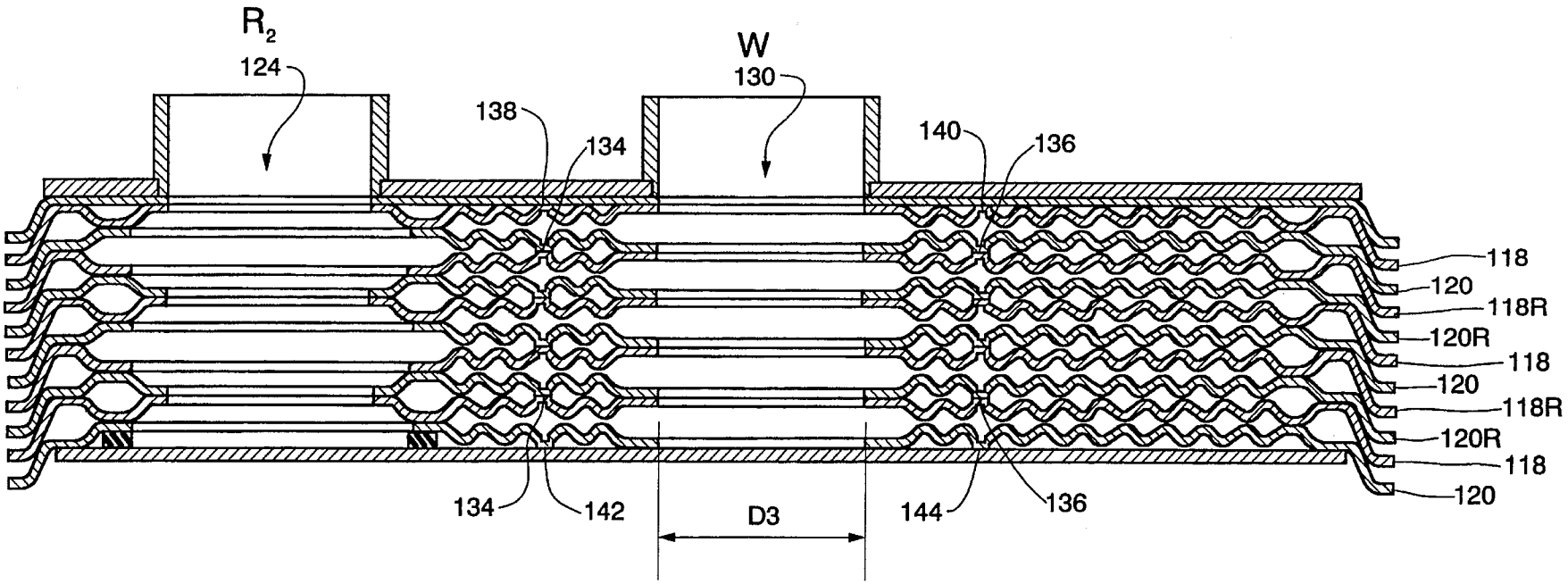

I have found that the refrigerant flow pattern can be improved for horizontally-mounted water chillers according to the invention by configuring the heat exchange portions of the plates to form baffles in the refrigerant flow passages for controlling and directing the flow of the refrigerants. FIGS. 12 through 14 show a two-plate chiller with two baffles in each refrigerant passage and FIG. 15 shows a chiller requiring more than two plate configurations and incorporating a single baffle in each refrigerant passage.

Referring first to FIGS. 12 through 14, heat exchanger 100 includes a cover plate 112, back plate 114, top sealing plate 116 and an interior stack of 10 plates 118, 120, 118R, 120R; as in FIGS. 1 through 5, the addition of "R" to a plate number signifies that the plate has been rotated 180° from the initial orientation at the top of the stack. The overall construction of chiller 100 duplicates that of heat exchanger 10 in FIGS. 1 and 2, but the two differ in the location of their fluid conduits and in the fact that chiller 100 includes the baffles mentioned hereinabove and to be more particularly described below.

In chiller 100 each of interior plates 118, 120, top sealing plate 116 and cover plate 112 has six generally circular ports cut through it for allowing fluid passage. FIG. 10 shows the port locations in cover plate 112; first and second ports 122,124 are adjacent to each other near the lower right corner of the plate viewing FIG. 12; third and fourth ports 126, 128 are adjacent to each other near the plate's diagonally opposite corner; and fifth and sixth ports 130, 132 are at opposite ends of the plate. The centers of ports 122 and 128 are first and second distances E1 and E2 from the axes A-long and A-lat, respectively; the centers of ports 124 and 126 are distance E1 from axis A-long and a third distance E3 from axis A-lat; and the centers of ports 130 and 132 lie on axis A-long and are equidistant from axis A-lat. The port locations of plate 112 are duplicated in top sealing plate 116 and in each interior plate 118, 120; with such arrangement proper port alignment is maintained when plates 118 and 120 are rotated 180° , as is evident in FIGS. 13 and 14.

In FIGS. 12 through 14 the inlet and outlet conduits for refrigerant R1 are formed at port location 122 and 126; those for refrigerant R2 are formed at port locations 124 and 128 and those for water W are formed at port locations 130 and 132.

To provide the preferred fluid flow patterns illustrated in FIGS. 3–5, the port sealing configurations of plates 118 and 120— i.e. the annular planar platforms around the ports, are identical to those of plates 18 and 20 respectively in FIGS. 2 through 9 and the platforms lie in one of two parallel planes corresponding to $P_u$ and $P_l$ in FIGS. 7 and 9. Thus, around port locations 122 and 126 the configuration of plate 118 is like that around ports 26 of plate 18 and the configuration of plate 120 is like that around ports 32 of plate 20; around port locations 124 and 128 plate 118 is configured like plate 18 around ports 28 and plate 120 is configured like plate 20 around ports 34; and around port locations 130 and 132 plate 118 is configured like plate 18 around ports 30 and plate 120 is configured like plate 20 around ports 36.

To control and direct flow of refrigerants R1 and R2 in the chiller of FIGS. 12 through 14, plates 118 and 120 are configured to form two baffles 134, 136 in each refrigerant flow passage; locations and lengths of the baffles are shown in broken lines in FIG. 12 and the plate configurations forming them are shown in cross section in FIG. 14. As so shown, the surface of each plate 118 is configured to include first and second longitudinally extending peaks 138, 140 the tops of which lie in the upper parallel plane corresponding to plane $P_u$ of FIGS. 6 and 8. Peak 138 is located between port location 130 and port location 124 and extends from the end of the plate nearest these ports—i.e. the right end viewing FIG. 12, to a point spaced from the opposite end by a distance of up to about one-third the plate width. Peak 140 lies between port location 132 and port location 126 and extends from the end of the plate nearest those ports—i.e. the left end viewing FIG. 12, to a point spaced from the opposite end by a distance of up to about one-third the plate width. For proper positioning when the plates are reversed, peaks 138 and 140 are parallel to and equidistant from axis A-long. To complete the baffle structure each plate 120 is configured to include first and second valleys 142, 144 the bottoms of which lie in the lower parallel plane corresponding to $P_l$ of FIGS. 6 and 8 and which have the same location and length on the plate as peaks 138 and 140, respectively, in plate 118.

With plates 118 and 120 configured as described and as shown in FIGS. 13 and 14, peaks 138, 140 in plate 118 abut valleys 142, 144 in plate 120 whenever a plate 120 is above a plate 118, to form baffles 134 and 136 in each fluid passage where such abutment occurs. A cross sectional fluid flow pattern of the stack of FIGS. 13 and 14 is the same as that shown in FIGS. 3 to 5, so it will be seen that with the plate configuration of FIG. 14, the baffle forming abutments occur only in the refrigerant passages and thus do not affect the flow of water through the chiller. Referring to FIG. 12, when the refrigerants are introduced at locations 122 and 124, their flow through the horizontally-mounted stack follows the general path indicated by arrow F. Thus, baffles 134 and 136 control and direct refrigerants R1 and R2 so that they make heat exchange contact with the full extent of their passage walls and in turn with the water passages adjacent thereto.

Although the foregoing description has dealt with the preferred embodiment of my invention wherein the interior stack of the heat exchanger is built up of plates having only two different surface configurations, it will be understood that other embodiments are within the scope of the invention. Thus a suitable interior stack may comprise plates having three or more different surface configurations, each plate having six ports cut through it with the ports sized and positioned so that when the exchanger is assembled they form inlet and outlet conduits through the stack for each of the first, second and third fluids. For proper functioning according to my invention, such interior stack must include at least six plates and each pair of adjacent plates must be connected in a fluid-tight manner around four of the six ports in a repeating group of four successive plates, with the first and second plates connected at the inlet and outlet ports for the first and second fluids, the second and third plates connected at the inlet and outlet ports for the first and third fluids, the third and fourth plates connected at the inlet and outlet ports for the first and second fluids and the fourth plate and first plate of the succeeding group of four connected at the inlet and outlet ports for the second and third fluids. As with the preferred two-plate embodiment, such alternative embodiments are generally intended for mounting in flat or vertical positions as hereinabove described. For horizontal position use, a plate configuration forming two baffles in each of the first and second fluid passages similar to that in FIG. 12 will of course improve the heat transfer. Alternatively, a series of single baffles can be helpful for that purpose. One such heat exchanger 150 is shown in top view in FIG. 15. As indicated there, the six ports in the cover plate as well as those in each plate of the interior stack are arranged as follows with respect to the horizontal and lateral axes of the plates A-long and A-lat, respectively: inlet ports 152,154 for the first and second fluids, respectively, are adjacent one another near a first corner of the plate; outlet ports 156, 158 for the first and second fluids, respectively, are adjacent one another near the laterally opposite corner of the plate; inlet port 160 for the third fluid is between ports 152 and 156 and at the same end of the plate as those ports; and outlet port 162 for the third fluid is at the opposite end of the plate from port 160. The surface of each first and third plate in the four-plate repeating internal stack pattern is configured to define a peak located laterally between ports 152 and 160 and extending longitudinally from a point at the right end of the plate viewing FIG. 15 to a point spaced from the opposite end, and the surface of each second and fourth plate in the four-plate pattern is configured to define a valley corresponding in length and position to the peaks in the first and third plates; the height of the peaks and depths of the valleys are such that the valleys in each second and fourth plate contact the peaks in each adjacent third and first plate to form a baffle 164, the location of which is shown in broken lines in FIG. 15. With the described configuration, the baffles control and direct the flow of the first and second fluids along the general path shown by the arrow F in FIG. 15, which improves heat transfer uniformity in the horizontal mounting position, although not to as great an extent as the two baffle arrangement of FIG. 12.

While I have shown and described certain present preferred embodiments of my invention, it is to be distinctly understood that the invention is not limited thereto but may be otherwise variously embodied within the scope of the following claims.

I claim:

1. A three-circuit stacked plate heat exchanger comprising a stack of at least six generally rectangular sheet metal plates of uniform outside dimensions arranged in a stacked relationship with the peripheries of adjacent plates connected in a fluid-tight manner, the stack having a top and a bottom, characterized in that:

a) the stack consists of first plates of a first configuration alternating with second plates of a second configuration, beginning with top first and second plates at the top of the stack;

b) the top first and second plates are both in a first position, the first and second plates immediately below the top first and second plates are both in a second position reached by rotation of 180° from the first position, and thereafter in the stack each first and second plate is rotated by 180° relative to the nearest first or second plate respectively above or below it;

c) each plate has lateral and longitudinal axes;

d) each plate includes a heat exchange portion in which the plate surface lies between spaced parallel upper and lower planes;

e) each plate has first through sixth generally circular ports cut through it for allowing fluid passage, said ports being so located on each plate that when adjacent first and second plates are both in said first or second position the first through sixth ports in the first plate are aligned with the corresponding first through sixth ports respectively in the second plate, and when a first plate in one of said first and second positions is adjacent to a second plate in the other of said first and second positions the first, second, third, fourth, fifth and sixth ports in the first plate are aligned respectively with the fourth, third, second, first, sixth and fifth ports in the second plate;

f) the surface of each first plate is configured such that:

i) each of said first and third ports has a first diameter and the plate surface around the edge of each said port defines an annular planar platform of a first width and distance from the port center lying in the lower of said parallel planes;

ii) each of said second and fourth ports has a second diameter and the plate surface around each said port defines first and second annular planar platforms, the first platform being of said first width and distance from the port center and lying in the lower of said parallel planes, the second platform being of a second width and distance from the port center and lying in the upper of said parallel planes, the inner edge of one of said first and second platforms being the edge of said port, the inner edge of the other of said first and second platforms being radially outward from the outer edge of said one platform, said plate surface further defining a section connecting the outer edge of said one of said platforms with the inner edge of said other of said platforms; and iii) each of said fifth and sixth ports has a third diameter and the plate surface around the edge of each said port defines an annular planar platform of a third width lying in the upper of said parallel planes;

g) the surface of each second plate is configured such that:

i) each of said first and third ports has said abovementioned second diameter and the plate surface around each said port defines first and second annular planar platforms, the first platform being of said abovementioned first width and distance from the port center and lying in the upper of said parallel planes, the second platform being of said abovementioned second width and distance from the port center and lying in the lower of said parallel planes, the inner edge of one of said first and second platforms being the edge of said port, the inner edge of the other of said first and second platforms being radially outward from the outer edge of said one platform, said plate surface further defining a section connecting the outer edge of said one of said platforms to the inner edge of said other of said platforms;

ii) each of said second and fourth ports has said abovementioned first diameter and the plate surface around the edge of each said port defines an annular planar platform of said above-mentioned first width and distance from the port center lying in the upper of said parallel planes; and iii) each of said fifth and sixth ports has said above-mentioned third diameter and the plate surface around the edge of each said port defines an annular planar platform of said above-mentioned third width lying in the lower of said parallel planes; and h) abutting surfaces in adjacent plates are joined in a fluid-tight manner.

2. A heat exchanger as claimed in claim 1 in which said abutting surfaces in adjacent plates are joined by vacuum brazing.

3. A heat exchanger as claimed in claim 1 in which in each plate said first, second and fifth ports are near one end of the plate, said third, fourth and sixth ports are near the opposite end of the plate, the centers of said first, second, third and fourth ports define the corners of a rectangle which is symmetrical with respect to the longitudinal and lateral axes of the plate, and the centers of said fifth and sixth ports lie on the longitudinal axis of the plate and are equidistant from the lateral axis of the plate.

4. A heat exchanger as claimed in claim 3 in which said abutting surfaces in adjacent plates are joined by vacuum brazing.

5. A heat exchanger as claimed in claim 1 in which:

a) in each plate said first and second ports are adjacent to each other near one corner of the plate, said third and fourth ports are adjacent to each other near the diagonally opposite corner of the plate, said fifth and sixth ports are at respectively opposite ends of the plate, the centers of both said first and fourth ports are first and second distances from the longitudinal and lateral axes of the plate respectively, the centers of both said second and third ports are said first distance from the longitudinal axis of the plate and a third distance from the lateral axis of the plate, and the centers of said fifth and sixth ports lie on the longitudinal axis of the plate and are equidistant from the lateral axis of the plate;

b) the surface of each first plate includes first and second longitudinally extending peaks the tops of which lie in the upper of said parallel planes, said first peak lying between said fifth port and said first and second ports and extending from a first end of the plate nearest said first and second ports to a point spaced from the opposite end of the plate by a distance of up to about one-third of the plate width, said second peak lying between said sixth port and said third and fourth ports and extending from said opposite end of the plate to a point spaced from said first end of the plate by a distance of up to about one-third of the plate width, said peaks being equidistant from and parallel to the longitudinal axis of the plate; and c) the surface of each second plate includes first and second longitudinally extending valleys the bottoms of which lie in the lower of said parallel planes, the positions and lengths of said first and second valleys corresponding to the positions and lengths of said above-mentioned first and second peaks, respectively.

6. A heat exchanger as claimed in claim 5 in which said abutting surfaces in adjacent plates are joined by vacuum brazing.

* * * * *